US007621346B1

(12) United States Patent
Trinh et al.

(10) Patent No.: US 7,621,346 B1
(45) Date of Patent: Nov. 24, 2009

(54) HYDROSTATIC BEARING

(75) Inventors: Tu Tien Trinh, Houston, TX (US); Eric Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/238,930

(22) Filed: Sep. 26, 2008

(51) Int. Cl.
*E21B 10/00* (2006.01)

(52) U.S. Cl. ..... 175/371; 175/331; 175/359; 175/367; 175/369; 384/92; 384/93

(58) Field of Classification Search ..... 175/331, 175/343, 359, 367, 369, 371; 384/92, 93
See application file for complete search history.

(56) References Cited

U.S. PATENT DOCUMENTS 3,746,405 A * 7/1973 Welton ..... 384/93
4,220,377 A * 9/1980 Phelps ..... 384/96
4,235,295 A * 11/1980 Zyglewyz ..... 175/371
4,252,383 A * 2/1981 Simpson ..... 384/93
4,560,014 A 12/1985 Geczy
5,054,938 A * 10/1991 Ide ..... 384/117
5,586,611 A * 12/1996 Dorosz ..... 175/369
5,593,231 A 1/1997 Ippolito
6,053,264 A * 4/2000 Frankel et al. ..... 175/371
6,460,635 B1 10/2002 Kalsi et al.
7,387,177 B2 6/2008 Zahradnik et al.
2007/0081747 A1 4/2007 Dick et al.

* cited by examiner

*Primary Examiner*—Jennifer H Gay
*Assistant Examiner*—Blake Michener
(74) *Attorney, Agent, or Firm*—Bracewell & Giuliani LLP

(57) ABSTRACT

A roller cone bit having a sealed lubricant reservoir between a roller cone and a head section. A journal sleeve is included on the head section that circumscribes the journal bearing surface of the head section. The sleeve can axially pivot on the head section, but does not rotate thereon. The reservoir is formed into a journal bearing surface of the head section body and may be sealed by placing a seal around its periphery that extends between the journal bearing surface and journal sleeve. Sealing the reservoir results in a hydrostatic condition therein and substantially equalized pressures.

21 Claims, 4 Drawing Sheets

HYDROSTATIC BEARING

BACKGROUND

1. Field of Invention

This disclosure relates to a bearing for a roller cone bit. Specifically, the present disclosure concerns a hydrostatic bearing assembly employing a sealed lubricant reservoir located in a high stress region of the bearing.

2. Description of Prior Art

Drill bits used in drilling of subterranean well bores typically comprise drag bits and roller cone bits. Roller cone bits typically comprise a body having legs extending downward and a head bearing extending from the leg towards the axis of the bit body. Frusto-conically shaped roller cones are rotatably mounted on each of these journals and are included with cutting teeth on the outer surface of these cones. Because of the high stresses incurred during drilling operations, the bearing mating surfaces within the bit require a bearing material or a surface treatment to sustain the loads and extend the bit life.

FIG. 1 provides in a side cross-sectional view an example of a portion of a roller cone drill bit 10. In this example the roller cone bit 10 includes a body 11 having a bearing pin 14 depending from its lower end. A roller cone 12 is shown rotatingly mated onto the bearing pin 14. A set of balls 16 is provided in an annular opening formed between the cone 12 and the head 14 and serves as a cone-retention system. A secondary purpose of the balls 16 is to provide a rolling surface for facilitating rotation of the cone 12.

Compacts 20 are shown extending outward from the cone 12 surface. Rotating the bit 10 on a wellbore bottomhole BH in turn rotates the cone 12 to engage the compacts 20 with the bottomhole formation 21. Adding weight on bit force with cone 12 rotation crushes the bottomhole formation 21 under the applied force of the compacts 20. Traditionally, a journal bearing element 18 is disposed in a recess 19 circumferentially formed within the head section 14. The journal bearing element 18 accommodates the cone 12 rotation and the forces transferred between the cone 12 and the head section 14. A significant amount of the transferred forces exerted on head section 14 and the roller cone 12 contact surface are concentrated in the region between the head 14 and the bottomhole BH. For the purposes of discussion herein, this region is referred to as the lower portion 22. The concentrated force on the lower portion 22 urges lubricant between the head 14 and roller cone 12 out of the lower portion 22 thereby causing metal to metal contact, that in turn accelerates material wear along the head 14 and roller cone 12 contact surface in the lower portion 22.

SUMMARY OF INVENTION

The disclosure herein provides an earth boring bit comprising, a bit body, a leg section depending from the body, a bearing pin extending from the leg having a journal bearing surface, a journal sleeve coaxially mounted on the journal bearing surface and enclosing the lubricant reservoir, a lubricant reservoir formed between the journal bearing surface and the journal sleeve, a reservoir seal surrounding the lubricant reservoir and in sealing contact between the journal bearing surface and the journal sleeve, a roller cone rotatingly coupled on the bearing pin over the journal sleeve, and a primary seal between the cone and the bearing pin. The cone is rotatable relative to the journal sleeve and the journal sleeve is optionally pivotable about an axis of the bearing pin. The lubricant reservoir may extend circumferentially along the journal bearing circumference up to or less than 360°. Optionally, additional reservoirs may be included on the journal bearing circumference. The earth boring bit may also include a primary seal extending circumferentially around the bearing pin for sealing lubrication between the cone and the bearing pin.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
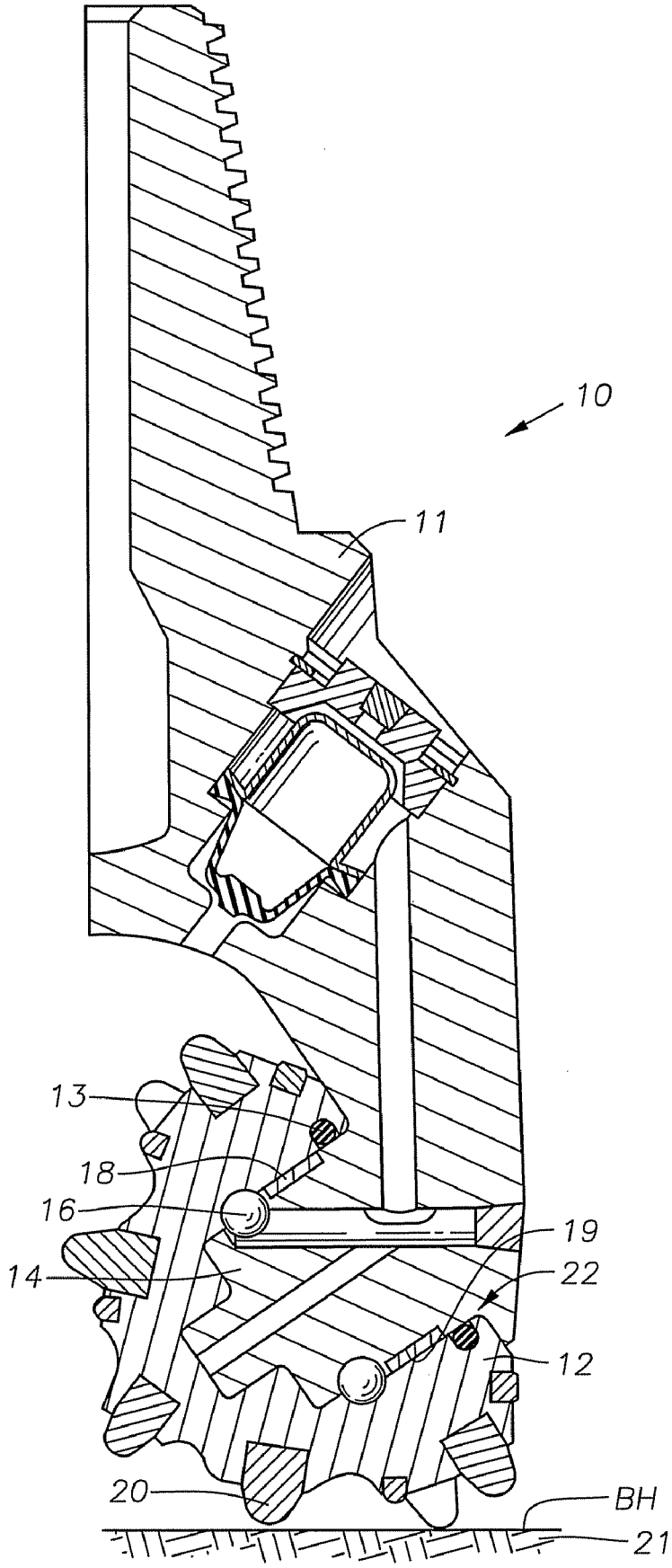
Fig. 1 (Prior Art)
FIG. 1 is a cross-sectional view of a portion of a roller cone bit.
Figure 2:
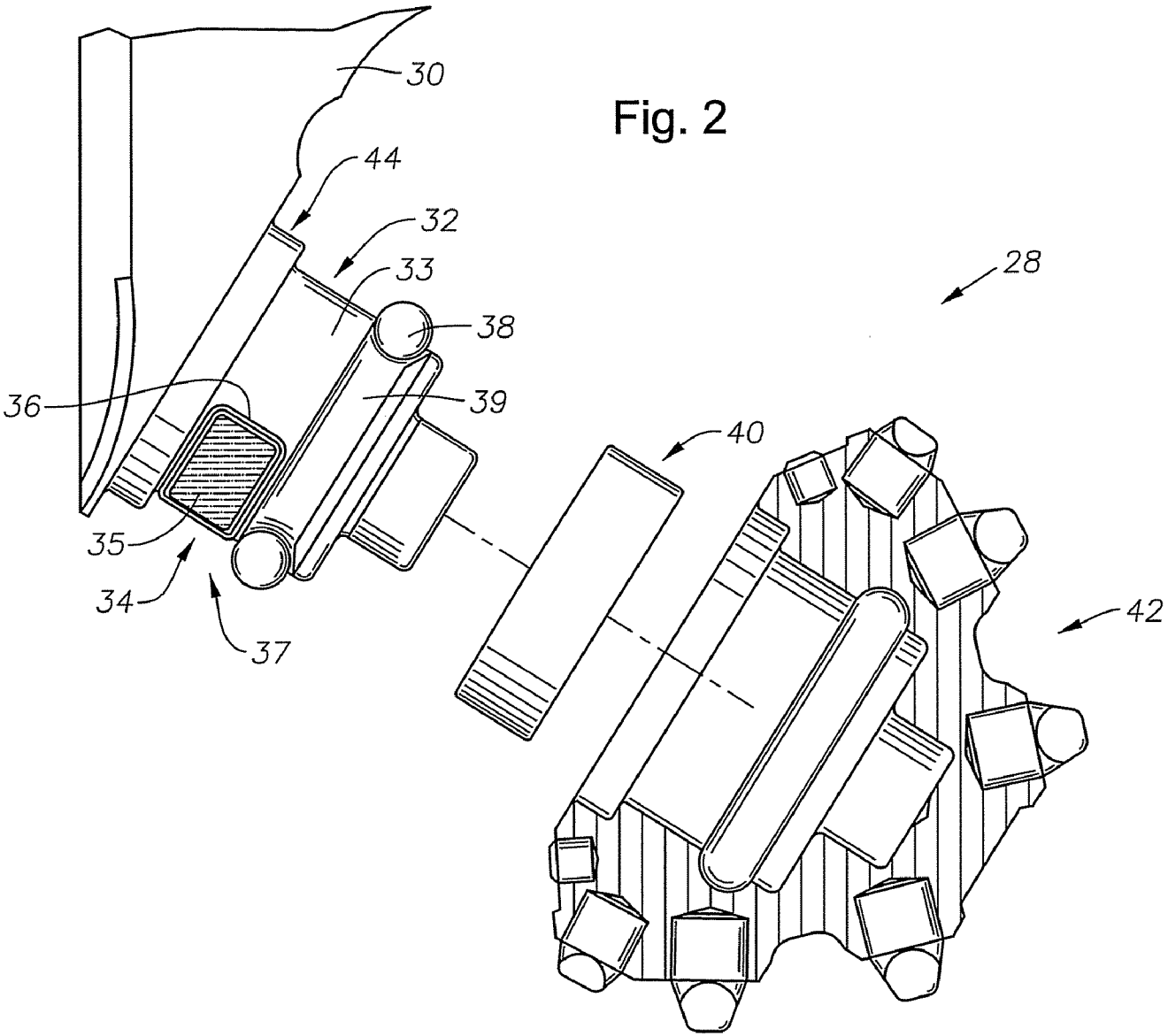
FIG. 2 is an exploded view of a portion of a roller cone bit.

An embodiment of a roller cone bit 28 in accordance with the present disclosure is shown in a side exploded view in FIG. 2. A bit leg 30 lower portion is shown having a bearing pin 32 laterally extending from the leg 30. The bearing pin 32 is a cylindrical member having a journal bearing surface 33 adjacent its attachment to the leg 30. A ball race 39 is provided coaxially adjacent the journal bearing surface 33 on the side opposite the leg 30. The ball race 39 provides a surface for a series of balls 38 that affix a roller cone to the bearing pin 32. An optional shoulder 44 is shown included between the leg 30 and journal bearing surface 33. The shoulder 44 circumscribes the bearing pin 32 and has an outer diameter exceeding the journal bearing surface 33 outer diameter.

Formed on the journal bearing surface 33 is a lubricant reservoir 34 having a lubricant 35 therein. In the embodiment of FIG. 2, the reservoir 34 is largely rectangular having sides substantially parallel with the respective ends of the journal bearing surface 33. The reservoir 34 extends along the lower portion of the journal bearing surface 33 having ends shown perpendicular to the reservoir 34 sides. A seal 36 extends around the reservoir 34 outer periphery. The seal 36 may be comprised of any suitable seal material, such as an elastomeric, a metal, or, as described in more detail below, corresponding grooves and indentations. Still referring to FIG. 2, an annular journal sleeve 40 is illustrated aligned for insertion onto the bearing pin 32. When inserted on the bearing pin 32, the journal sleeve 40 circumscribes the bearing pin 32 around the journal bearing surface 33. The seal 36 should be sized such that when the journal sleeve 40 is positioned around the journal bearing surface 33, the seal 36 extends into sealing contact with both the journal bearing surface 33 and the journal sleeve 40 inner annular surface. The seal 36 thus forms a sealing barrier between the journal bearing surface 33 and the journal sleeve 40 and around the lubricant reservoir 34. The seal 36, by encircling the reservoir 34, prevents any substance from within the reservoir 34 from migrating past the seal 36 thereby forming a hydrostatic region within the space bounded by the seal 36.

A force applied to the sealed hydrostatic region pressurizes the entrapped lubricant. When the lubricant comprises a fluid like substance, the lubricant pressure will be substantially equal throughout. Accordingly, an applied force to a fluid like lubricant distributes the applied force substantially equally throughout the lubricant. Distributing the pressure throughout the lubricant in turn equally distributes force from the entrapped lubricant to the journal bearing surface 33 portion adjacent the reservoir 34. Distributing the force through the reservoir 34 prevents load concentrations on the journal bearing surface 33. Thus when the bit 28 is in use loads transferred between the roller cone 42 and the bearing pin 32 can be evenly distributed to the journal bearing surface 33 along an area substantially equal to the reservoir 34 area. Examples of substances provided within the reservoir 34 include lubricants and other friction reducing materials. The lubricants can comprise any known lubricant including Newtonian and non-Newtonian fluids, grease, silicon, thixotropic substances, and combinations thereof.

As noted above, increased loading occurs on the lower region 37 of the bearing pin 32. As such, the reservoir 34 is illustrated in the embodiment of FIG. 2 as being located primarily in the lower region 37. However, other embodiments exist wherein the reservoir 34 extends into other regions of the bearing pin 32 along the journal bearing surface 33, the reservoir 34 can also extend around the entire circumference of the journal bearing surface 33. Other embodiments exist where multiple reservoirs 34 are provided on the bearing pin 32.

Figure 3:
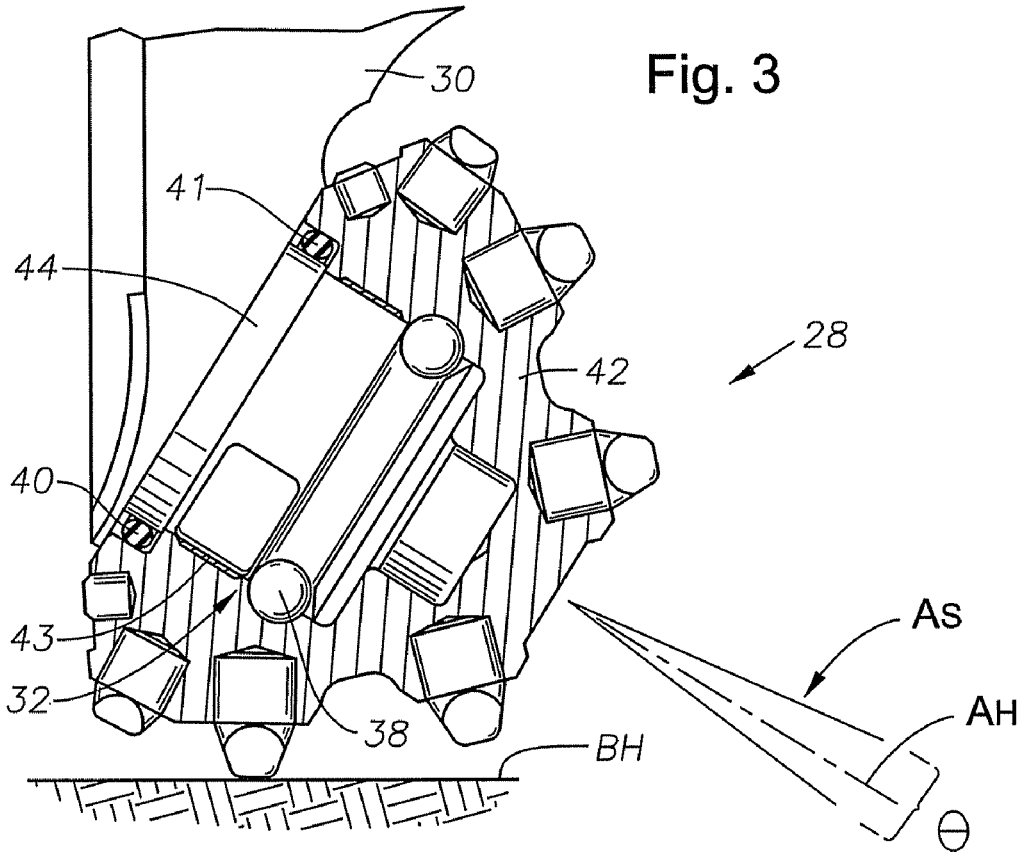
FIG. 3 is a side view of the roller cone bit of FIG. 2 as assembled.

In FIG. 3, a side partial sectional view of the drilling bit 28 as assembled. Here the journal sleeve 40 circumscribes the journal bearing surface 33 and the roller cone 42 is affixed on the bearing pin 32. In one embodiment, the journal sleeve 40 is non rotatable about the bearing pin 32. This may be accomplished by a key arrangement (not shown) that extends between the journal bearing surface 33 and the journal sleeve 40. However, other methods of preventing rotation about the journal sleeve 40 over the journal bearing surface 33 are available and included within the scope of this disclosure. Although the journal sleeve 40 may be prevented from rotating around the bearing pin 32; clearance between the journal sleeve 40 and the bearing pin 32 allows the journal sleeve 40 to pivot with respect to the axis $A_H$ of the bearing pin 32. For the purposes of illustration, the journal sleeve 40 axis $A_S$ is included to illustrate an example of pivoting motion having a range defined by the angle θ. Thus although the roller cone 42 rotates about the journal sleeve 40, the journal sleeve 40 pivots in response to cone 42 pivoting movement induced by torque applied to the cone 42 during excavating operations. The efficacy of the seal 36 however is not compromised by journal sleeve 40 pivoting and will continue to provide its sealing barrier function. Also illustrated in FIG. 3 is a primary seal 41 in sealing contact between the roller cone 42 and the journal sleeve 40. An inlay material 43 inserted between the roller cone 42 and the journal sleeve 40.

Figure 4:
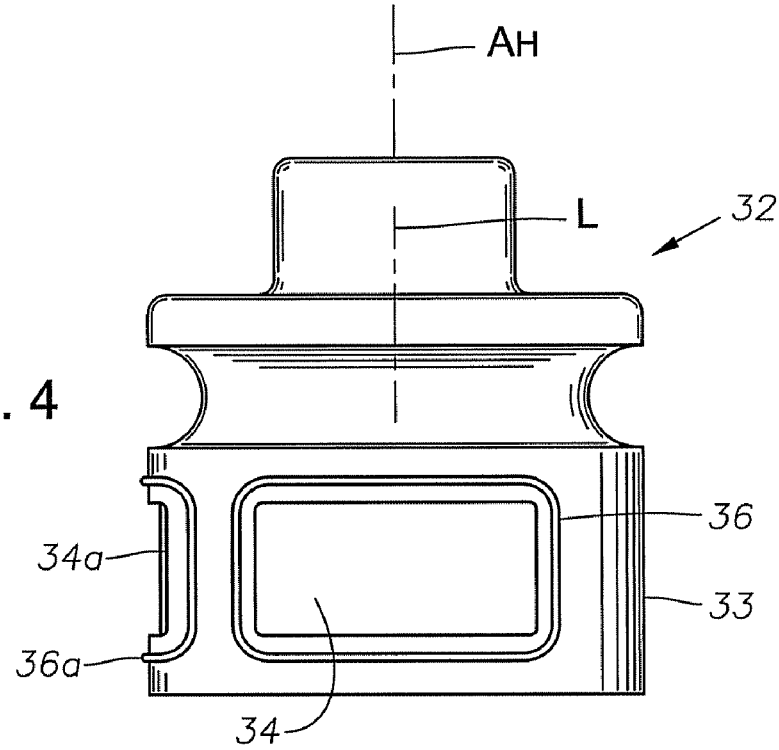
FIG. 4 is a view of a lower side of a head section of a bit assembly in accordance with the present disclosure.

FIG. 4 depicts an upward looking view of an embodiment of the head section 32 with a lubricant reservoir 34 provided on a lower portion of the head section 32 along the journal bearing surface 33. The seal 36 extends along the outer periphery of the reservoir 34. An optional second reservoir **34*a* with second seal 36*a* is also provided on the bearing pin 32. In one embodiment, the reservoir 34 extends approximately 70° to about 100° along the journal bearing surface 33 outer perimeter. Optionally, the lubricant reservoir may extend about 90° along the journal bearing surface 33 circumference. A line L is shown substantially parallel with the bearing pin 32 axis $A_H$. The line L represents the bearing pin 32 region (lower most region of the bearing pin 32) closest to the borehole surface $B_H$ (FIG. 3) during earth boring operations. In one optional embodiment, the reservoir 34 is bisected into two substantially equal sections by line L. Other embodiments exist where the reservoir 34** is asymmetric about line L.

Figure 5:
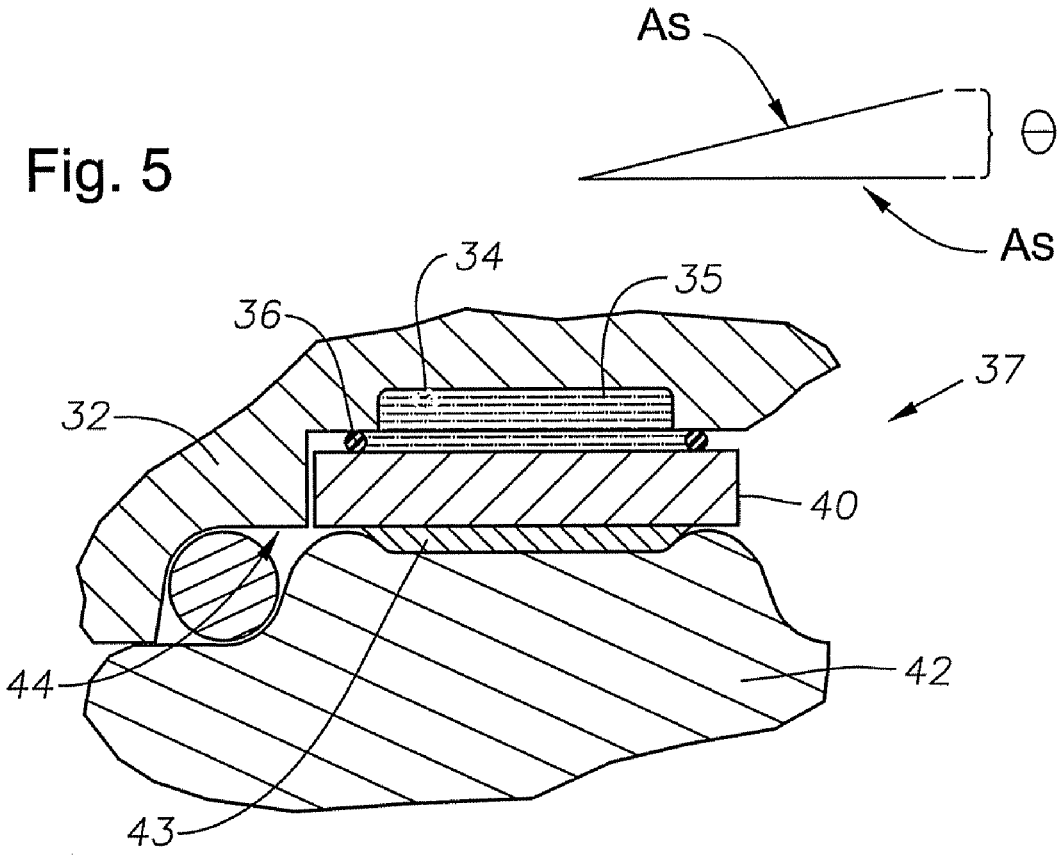
FIG. 5 is a sectional view of a portion of a bit in accordance with the present disclosure.

A cross sectional view of a portion of the bit 28 in accordance with the present disclosure as provided in FIG. 5. As shown, the seal 36 is in sealing engagement between the journal bearing surface 33 outer circumference and the inner circumference of the journal sleeve 40. Fluid 35, such as lubricant from the reservoir 34 extends from within the reservoir 34 and into the space between the journal bearing surface 33 and the journal sleeve 40. Seal 36 retains the lubricant 35 within the predefined region within a circumferential portion of the journal bearing surface 33 and the journal sleeve 40. Moreover, the seal 36 retains the lubricant 35 within this region during pivoting movement of the bearing sleeve 40 about its axis $A_S$. The forces transferred from the rotating roller cone 42 to the bearing pin 32 are first transferred to the journal sleeve 40 and to the lubricant 35 within the lubricant reservoir 34. As previously discussed, the lubricant 35 has a substantially equal pressure throughout the reservoir 34 thereby imparting substantially distributed forces into the journal bearing surface 33 and avoiding a force concentration. Accordingly, discreet portions of the bearing pin 32 should not experience excessive wear, instead an even amount of wear should be distributed along that surface, thereby prolonging the useful life of the bearing pin 32 and the drill bit 28.

Figure 6:
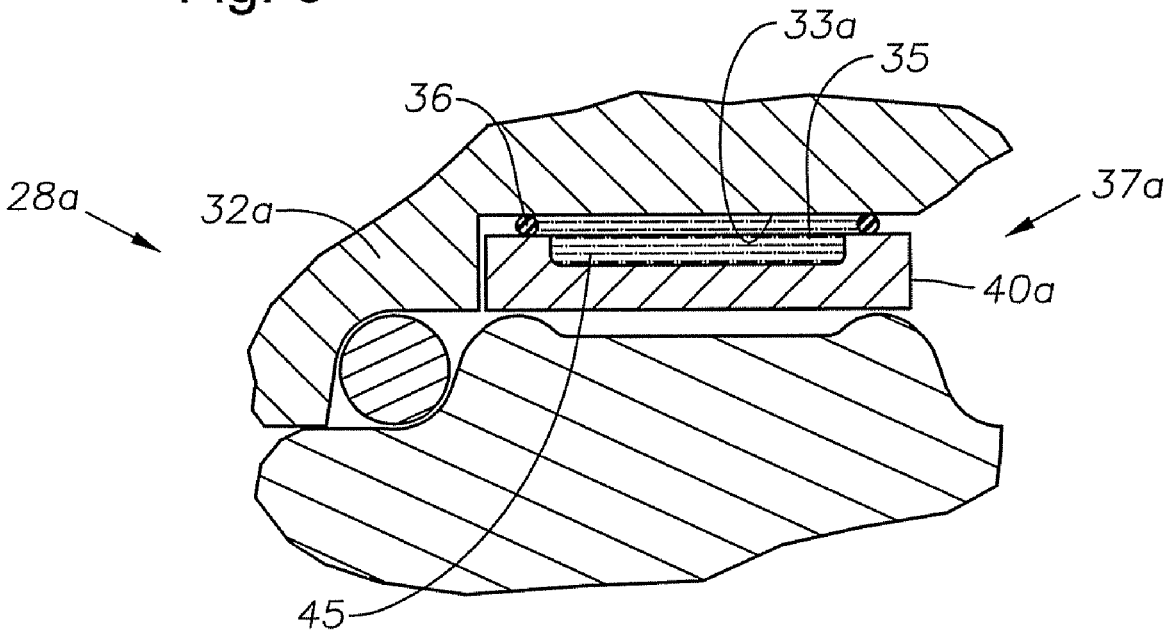
FIG. 6 is a sectional view of a portion of an alternative embodiment of a bit in accordance with the present disclosure.

A portion of an alternative bit **28*a* embodiment is illustrated in side sectional view in FIG. 6. In this embodiment a recess 45 is provided on the surface of the journal sleeve 40*a* facing the journal bearing surface 33*a*. Lubricant 35 is retained in the space between the journal sleeve 40*a* and the journal bearing surface 33*a* by a seal 36 circumscribing the reservoir 45**. Bit embodiments of the present disclosure include reservoirs between other moving surfaces, such as the thrust face, pilot pin to name but a few. Also optionally, a fluid circuit may be included for directing and/or replenishing lubricant to the reservoir. To prevent backflow to the lubricant supply, a check valve may be included within the fluid circuit.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

We claim:

1. An earth boring bit comprising:

a bit body;

a leg section depending from the body;

a bearing pin extending from the leg having a journal bearing surface;

a journal sleeve coaxially mounted on the journal bearing surface and enclosing the lubricant reservoir;

the lubricant reservoir formed between the journal bearing surface and the journal sleeve;

a reservoir seal surrounding the lubricant reservoir and in sealing contact between the journal bearing surface and the journal sleeve;

a roller cone rotatingly coupled on the bearing pin over the journal sleeve; and a primary seal between the cone and the bearing pin.

2. The earth boring bit of claim 1, wherein the cone is rotatable relative to the journal sleeve.

3. The earth boring bit of claim 2, wherein the journal sleeve is pivotable about an axis of the bearing pin.

4. The earth boring bit of claim 1, wherein the lubricant reservoir comprises a recess formed on a lower side of the journal bearing surface.

5. The earth boring bit of claim 1, wherein the lubricant reservoir comprises a recess formed on an inner surface of the journal sleeve.

6. The earth boring bit of claim 1, wherein the lubricant reservoir extends circumferentially along the journal bearing circumference less than 360°.

7. The earth boring bit of claim 1, wherein the lubricant reservoir has parallel side edges and ends that are substantially perpendicular to the side edges.

8. The earth boring bit of claim 1 wherein the reservoir seal comprises an element selected from the list consisting of an elastomeric seal, a metal seal, an indentation formed in the journal sleeve extending into a corresponding groove in the journal bearing surface, and an indentation formed in the journal bearing surface extending into a corresponding groove in the journal sleeve.

9. The earth boring bit of claim 1, further comprising a second reservoir bounded by a second reservoir seal and formed in the journal bearing surface.

10. An earth boring bit comprising:

a bit body;

a leg section depending from the body;

a bearing pin extending from the leg section;

a roller cone rotatingly coupled on the bearing pin;

a reservoir of lubricant disposed between the roller cone and the bearing pin, the reservoir comprising a recess formed in an exterior lower surface of the bearing pin and extending less than 360° about the bearing pin;

a reservoir seal extending around a perimeter of the reservoir for sealing lubricant within the reservoir; and a primary seal extending circumferentially around the bearing pin for sealing lubrication between the cone and the bearing pin.

11. The earth boring bit of claim 10, further comprising a journal bearing surface on the bearing pin and a journal sleeve mounted on the journal bearing surface, the journal sleeve being non-rotatable about the bearing pin, and the reservoir seal sealing between the journal bearing surface and the journal sleeve.

12. The earth boring bit of claim 11, wherein the journal sleeve has a width greater than a width of the reservoir.

13. The earth boring bit of claim 11, wherein the journal sleeve has a clearance between its inner diameter and the bearing pin outer diameter as to be pivotable with respect to an axis of the bearing pin.

14. The earth boring bit of claim 10, wherein the lubricant reservoir has parallel side edges and ends that are substantially perpendicular to the side edges.

15. The earth boring bit of claim 10, further comprising a second reservoir of lubricant extending circumferentially less than 360° around the bearing pin, the second reservoir comprising a recess formed in the bearing pin exterior surface, and a second reservoir seal extending around a perimeter of the second reservoir and sealing lubricant in the second reservoir from lubricant inside the first mentioned reservoir.

16. An earth boring bit comprising:

a bit body;

a leg section depending from the body;

a bearing pin extending from the leg section;

a roller cone rotatingly coupled on the bearing pin;

a reservoir of lubricant disposed between the roller cone and the bearing pin, the reservoir comprising a recess formed in an exterior lower surface of the bearing pin and extending less than 360° about the bearing pin;

a reservoir seal extending around a perimeter of the reservoir for sealing lubricant within the reservoir;

a journal bearing surface on the bearing pin and a journal sleeve mounted on the journal bearing surface, the journal sleeve being non-rotatable about the bearing pin, and the reservoir seal sealing between the journal bearing surface and the journal sleeve; and a primary seal extending circumferentially around the bearing pin for sealing lubrication between the cone and the bearing pin.

17. The earth boring bit of claim 16, wherein the lubricant reservoir has parallel side edges and ends that are substantially perpendicular to the side edges.

18. The earth boring bit of claim 16, wherein the journal sleeve has a width greater than a width of the reservoir.

19. The earth boring bit of claim 16, wherein the reservoir is generally rectangular.

20. The earth boring bit of claim 16, wherein the primary seal is between the bearing pin and the cone.

21. The earth boring bit of claim 16, wherein the cone is rotatable relative to the journal sleeve.

* * * * *